US008789882B2

(12) United States Patent
Bergkvist

(10) Patent No.: US 8,789,882 B2
(45) Date of Patent: Jul. 29, 2014

(54) FOLDING HIGH CHAIR WITH TABLE

(75) Inventor: Hakan Bergkvist, Bromma (SE)

(73) Assignee: BabyBjorn AB, Solna (SE)

( * ) Notice: Subject to any disclaimer, the term of this patent is extended or adjusted under 35 U.S.C. 154(b) by 279 days.

(21) Appl. No.: 13/262,390

(22) PCT Filed: Jan. 22, 2010

(86) PCT No.: PCT/SE2010/050059

§ 371 (c)(1),
(2), (4) Date: Oct. 18, 2011

(87) PCT Pub. No.: WO2010/114456

PCT Pub. Date: Oct. 7, 2010

(65) Prior Publication Data

US 2012/0025569 A1 Feb. 2, 2012

(30) Foreign Application Priority Data

Mar. 30, 2009 (SE) ..... 0900412

(51) Int. Cl.
*A47D 1/02* (2006.01)

(52) U.S. Cl.
USPC ..... 297/173; 297/154; 297/467

(58) Field of Classification Search
USPC ..... 297/154, 173, 467
See application file for complete search history.

(56) References Cited

U.S. PATENT DOCUMENTS 2,532,812 A * 12/1950 Huber ..... 297/149
2,851,084 A * 9/1958 Benjetsky ..... 297/254
2,971,570 A 2/1961 Vander Bush
4,422,658 A * 12/1983 Hilliard ..... 280/47.4
4,722,570 A 2/1988 Bertoli
5,326,327 A 7/1994 Stephens et al.
5,507,550 A 4/1996 Maloney
5,533,786 A * 7/1996 Cone, II ..... 297/256.15
5,593,207 A * 1/1997 Turner ..... 297/281

(Continued)

FOREIGN PATENT DOCUMENTS

DE 20111627 U1 3/2002
EP 1702537 A1 9/2006

(Continued)

OTHER PUBLICATIONS

International Search Report for International Application No. PCT/SE2010/050059 completed on Apr. 1, 2010, and mailed on Apr. 14, 2010.

(Continued)

*Primary Examiner* — Peter Brown
(74) *Attorney, Agent, or Firm* — Pearne & Gordon LLP

(57) ABSTRACT

A high chair comprising a seat (4), a backrest (3), a footrest (5), a crotch post (11), which is journalled in the chair for pivoting between a raised user position in front of the back rest and a lowered position, and a table (13) arranged on the crotch post (11), wherein the side (91) of the table (13) facing the back rest, when the crotch post is in a user position, together with the back rest forms a substantially closed formation (92) for safe-keeping of a child in the chair and wherein the table (13) in the lowered position of the crotch post is arranged to lie beyond the upper surface of the seat (4) and beyond at least part of the upper surface of the foot rest (5).

17 Claims, 8 Drawing Sheets

(56) References Cited

U.S. PATENT DOCUMENTS

| | | | | |
|---|---|---|---|---|
| 5,707,104 | A | 1/1998 | Perego | |
| 6,024,412 | A * | 2/2000 | Kain et al. | 297/467 |
| 6,129,414 | A | 10/2000 | Brevi | |
| 6,206,462 | B1 | 3/2001 | Huang | |
| 6,347,830 | B1 | 2/2002 | Chen | |
| 6,550,579 | B2 | 4/2003 | Gibson et al. | |
| 6,854,800 | B2 | 2/2005 | Perego | |
| 6,877,801 | B2 | 4/2005 | Asbach et al. | |
| 7,334,836 | B2 | 2/2008 | Chen | |
| 7,635,159 | B2 | 12/2009 | Chen et al. | |
| 7,905,549 | B2 * | 3/2011 | Lake et al. | 297/344.19 |
| 8,177,297 | B2 * | 5/2012 | Powell et al. | 297/467 |
| 2005/0017549 | A1 | 1/2005 | Chen | |

FOREIGN PATENT DOCUMENTS

| | | | |
|---|---|---|---|
| GB | 846092 | A | 8/1960 |
| GB | 2450695 | | 1/2009 |
| WO | 9614219 | A1 | 5/1996 |

OTHER PUBLICATIONS

International Search Report; International Application No. PCT/SE2010/050060; Date of Actual Completion of International Search: Jun. 1, 2010; Date of Mailing of International Search Report: Jun. 2, 2010.

* cited by examiner

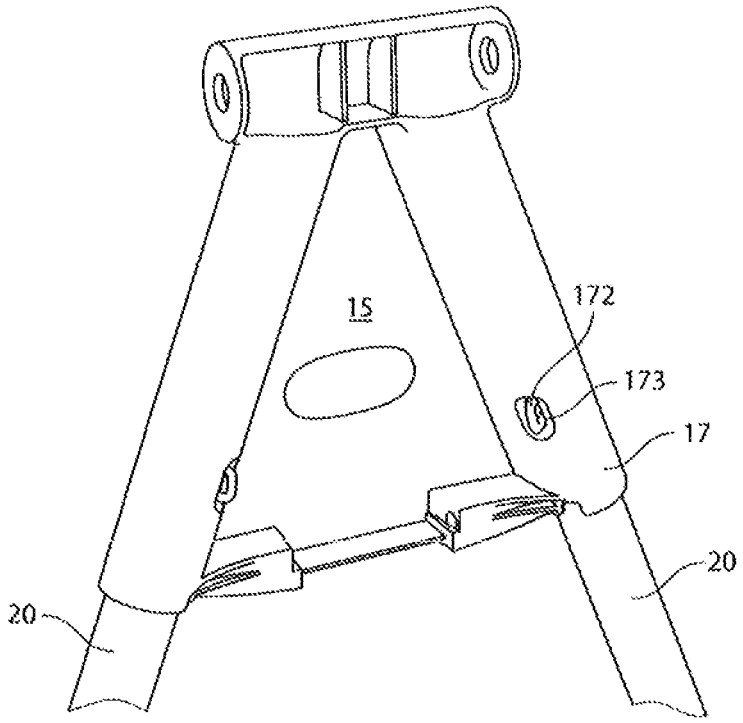
FIG. 6
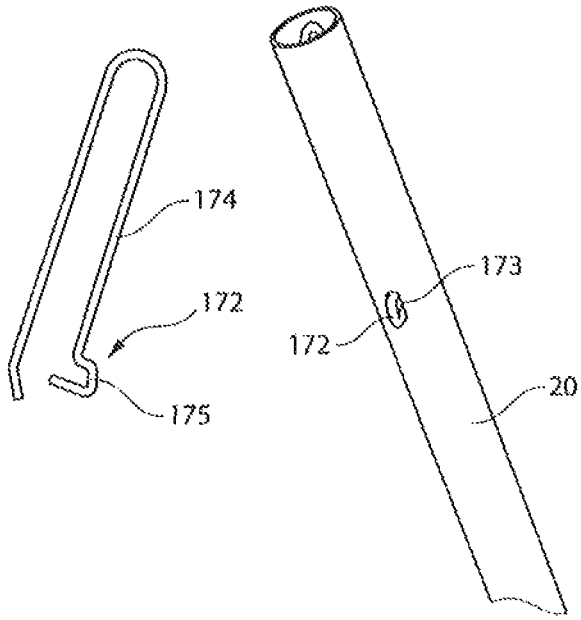
FIG. 7b
FIG. 7a

FOLDING HIGH CHAIR WITH TABLE

CROSS-REFERENCES TO RELATED APPLICATIONS

This application claims the benefit of PCT application number PCT/SE2010/050059 filed on Jan. 22, 2010 and incorporated herein by reference, which claims the benefit of foreign application number SE 0900412-8 filed on Mar. 30, 2009, also incorporated herein by reference.

FIELD OF INVENTION

The present invention relates to a folding high chair with table according to the preamble of claim 1.

PRIOR ART

There are a number of different high chairs in the market with and without table. These high chairs are often bulky and are normally not suitable for transport, e.g. in a car. Even if it is possible to dismount certain types of high chairs, it is nevertheless time consuming and labor-intensive. There are also many different structures, when it comes to tables for high chairs. When a high chair has a permanently mounted table, there are often problems both with placing the child in the chair and removing it there from. In connection with high chairs with removable tables there are special means designed so that the table optionally can be mounted on the chair and be removed there from with a child sitting in the chair. This implies that the chair must have a separate safety means in order to prevent the child from getting out or falling out of the chair when the table is removed. Accordingly, there is a need of an improved high chair with table.

The fact that known high chairs are troublesome to use can also lead to safety risks by not using the existing security improving elements there are or using them in the wrong way.

THE INVENTION

One object of the present invention is accordingly to provide a folding high chair with table, at which it is easy to place a child in the chair, to remove the child there from, while at the same time the chair easily can be collapsed and erected.

A further object of the invention is to provide an improved chair, which minimizes the risk for misuse and which is childproof.

These and other objects are achieved with the high chair according to the invention as it is defined in claim 1.

Preferred embodiments and developments of the invention are defined in the subclaims.

With the structure suggested according to the invention of a folding high chair with table a number of advantages are achieved. With known high chairs with a yoke it is often difficult to place the child in the chair and difficult to lift it up from the chair, and the child has to be lifted high up.

When the crotch post with table has been lowered the whole seat area as well as at least part of the upper surface of the footrest become completely free, and the child can easily and comfortably be placed in the chair, even if it is lively and/or resists the process, and further, one does not have to lift the child so high.

It is not possible to handle the chair in the wrong way or to remove any parts from the security equipment, as is the case with known chairs, for example yoke with removable crotch band. When the table is in a use position with the crotch post arrested, the child itself cannot get out of the chair. By a simple manoeuvring of a retaining mechanism, the table can be displaced so that an opening optimally adjusted to the child exists between the table and the backrest.

According to the presently preferred embodiment of the invention, a concave side of the table preferably passes over into side edges in a soft curve, the form of which shall be so adapted that with the table in a vertically aligned position, a chain laid in the concave cavity slides off, whereby the risk of hanging is substantially eliminated.

In summary, the chair according to the invention thus fulfils very high demand on user friendliness and security.

SHORT DESCRIPTION OF THE DRAWINGS

Further advantages, features and embodiments of the invention will be evident from the following detailed description of embodiments of the high chair according to the invention shown on the appended drawings. In the drawings:

FIG. 6 shows a partial view of a link for a rear leg pair;

Figure 8:
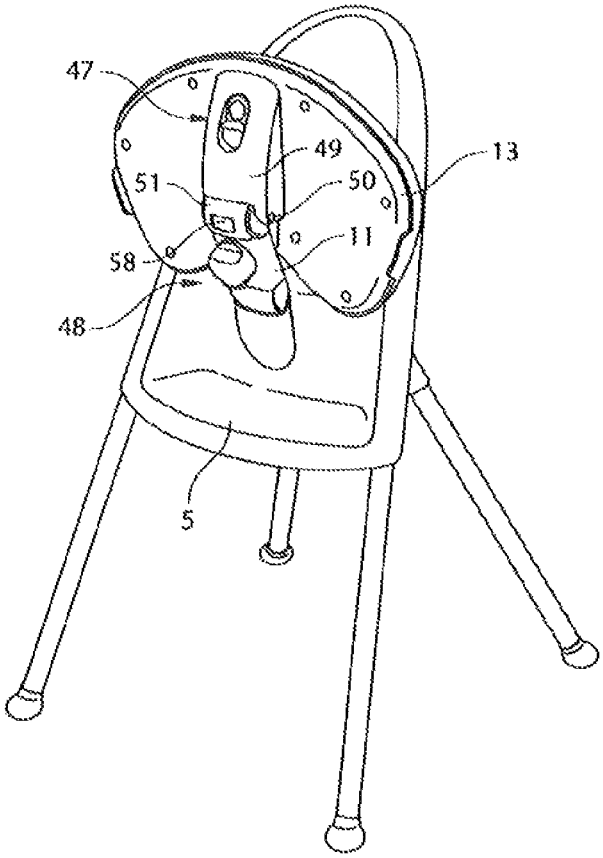
Figure 9:
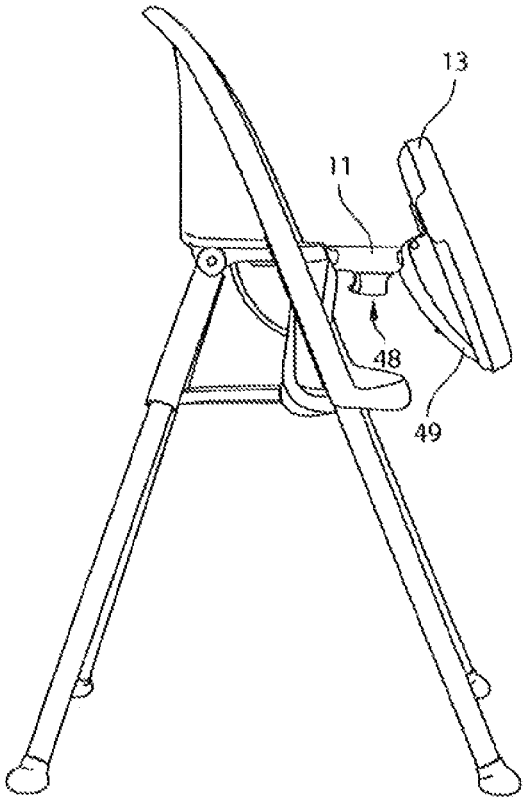
Figure 10:
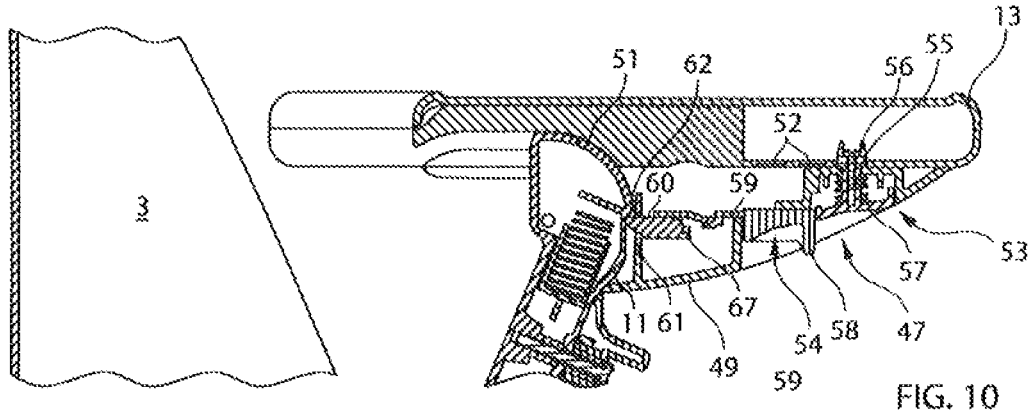
Figure 11:
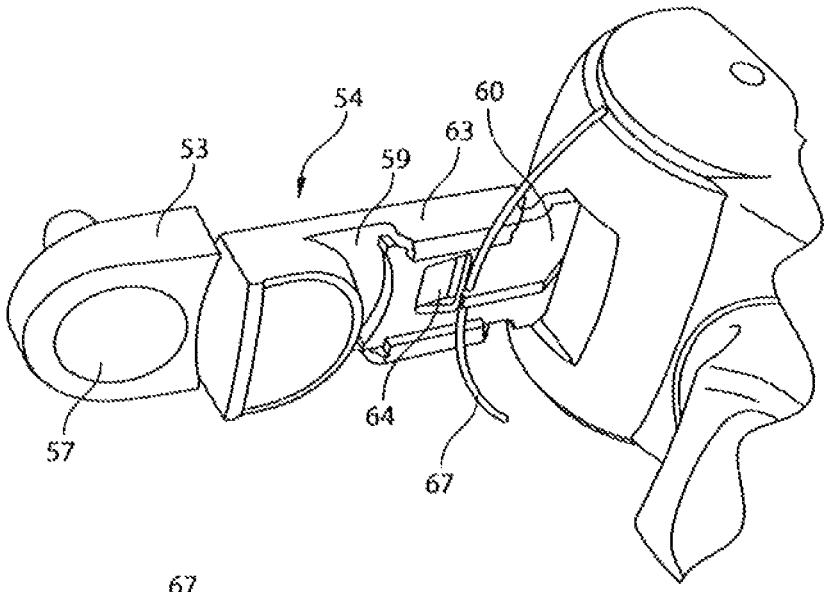
Figure 11A:
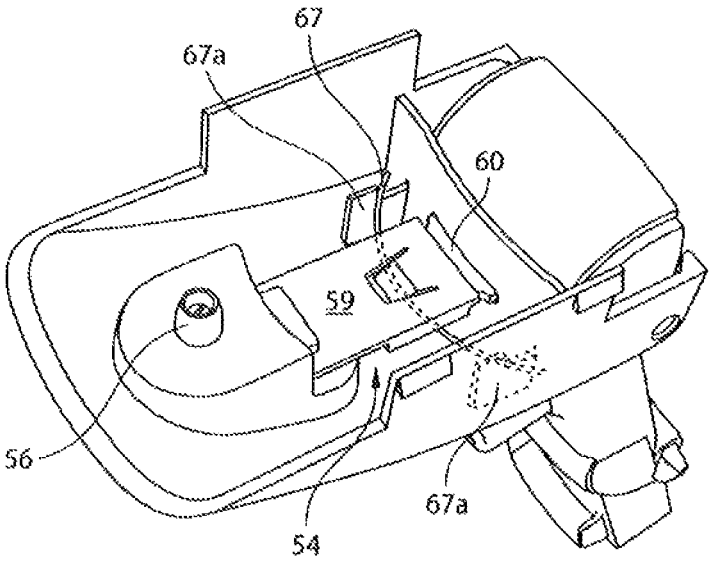
Figure 12:
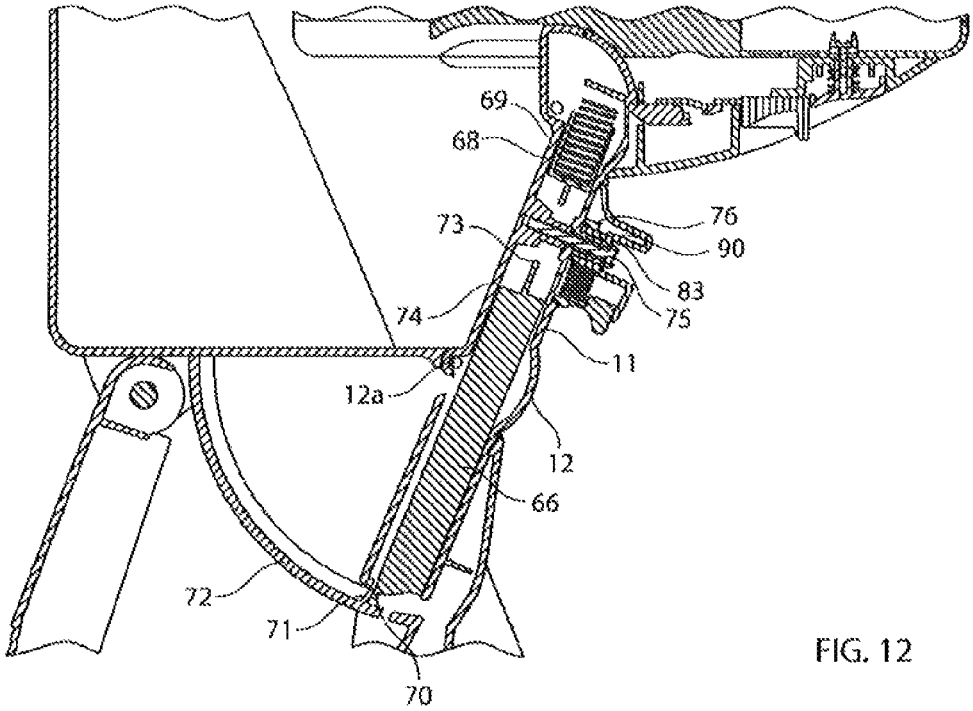
Figure 13:
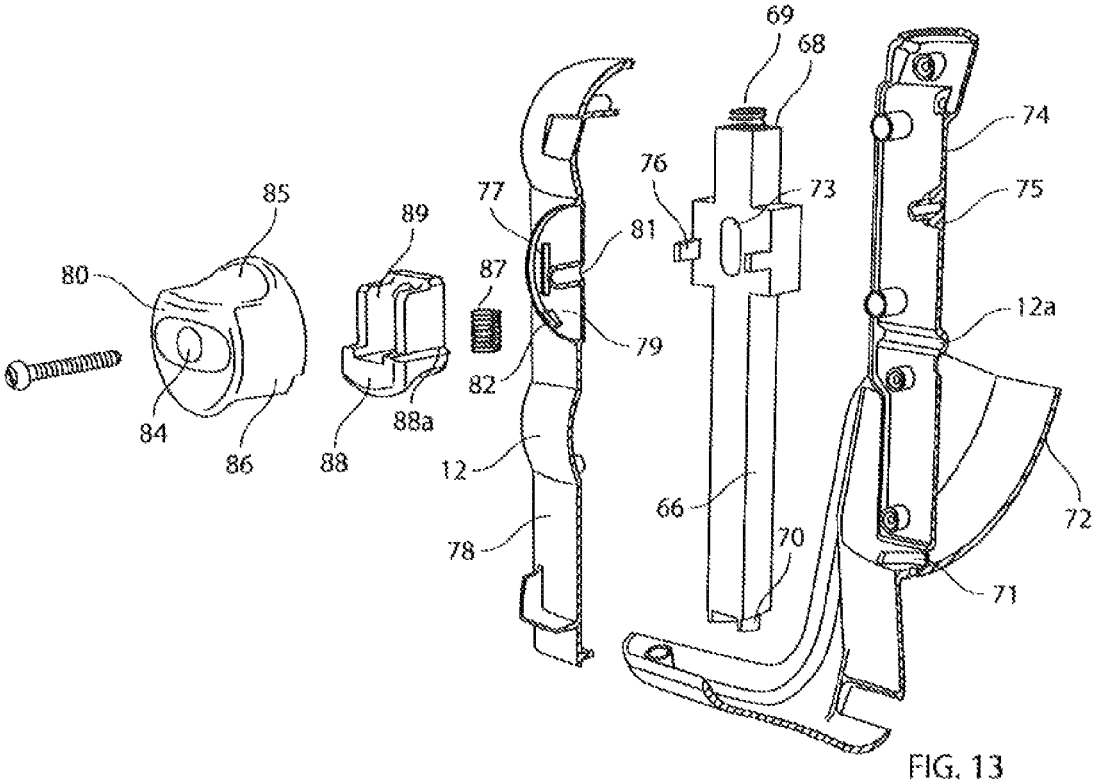
Figure 13A:
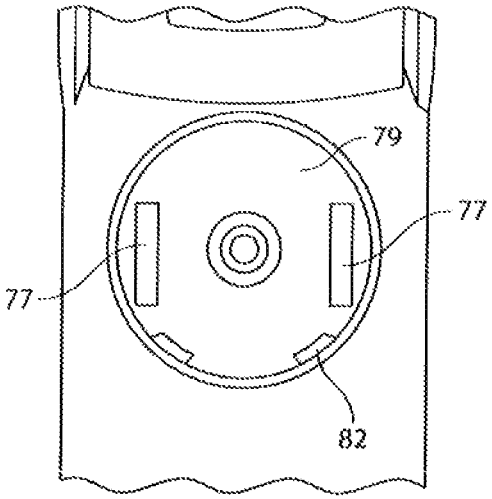
Figure 13B:
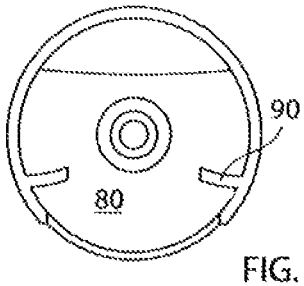

FIG. 7*a, b* shows an upper part of a leg and a retaining element, respectively;

FIG. 8 shows a perspective view of the chair with raised table;

FIG. 9 shows a side view of the chair with lowered crotch post;

FIG. 10 shows a partial cross sectional view of the table with control mechanism;

FIG. 11 shows a partially cut away view of the table from its underside;

FIG. 11*a* shows a view towards the inside of the cover of the underside of the table, FIG. 12 shows a cross sectional view from the side, showing the crotch post with retaining mechanism;

FIG. 13 shows an exploded view of the crotch post with retaining mechanism and controls;

FIGS. 13*a* and 13*b* show details from FIG. 13; and

Figure 14:
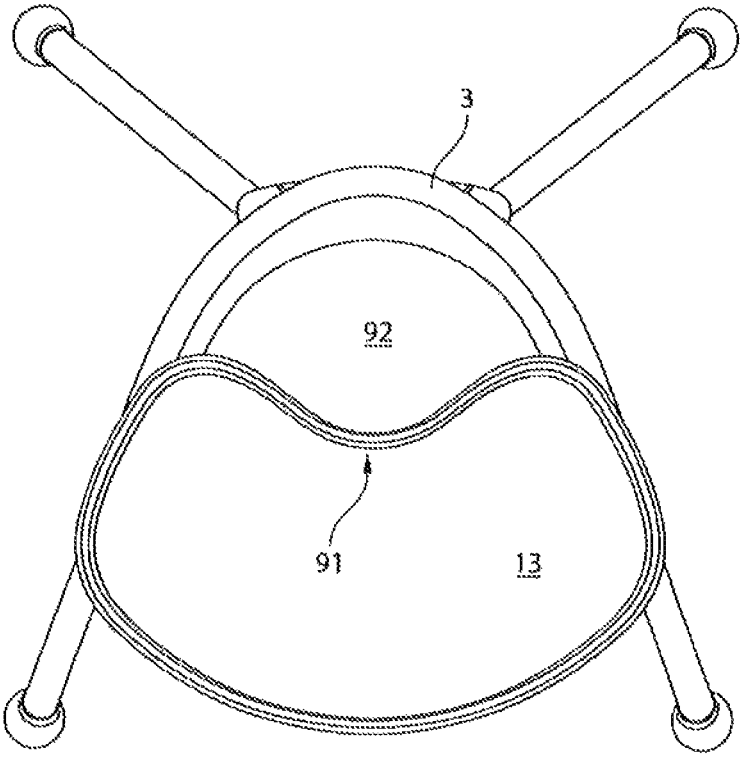

FIG. 14 shows a view of the chair according to the invention with the table in user position.

DETAILED DESCRIPTION OF EMBODIMENTS OF THE INVENTION

The invention will be described more in detail below in connection with the embodiments shown on the appended drawings.

Figure 1:
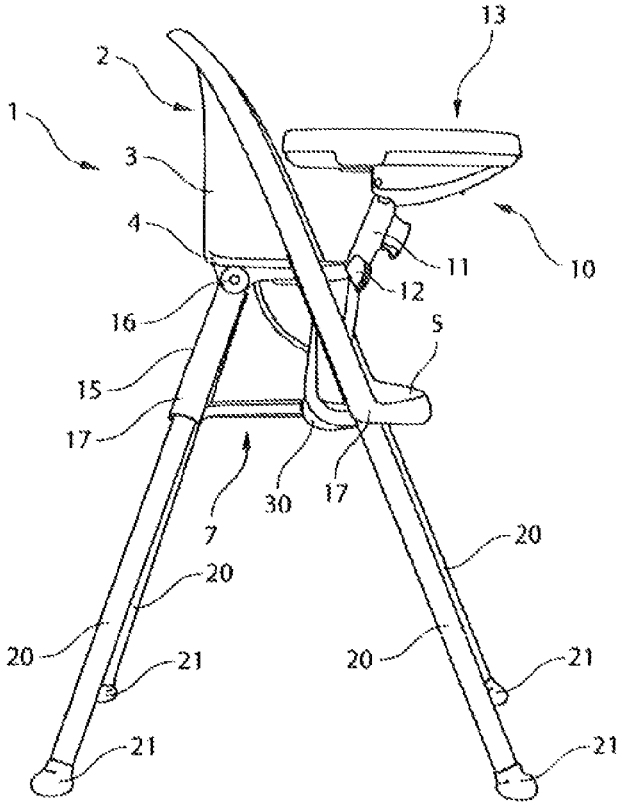
FIG. 1 shows a side view of a high chair according to the invention.
Figure 2:
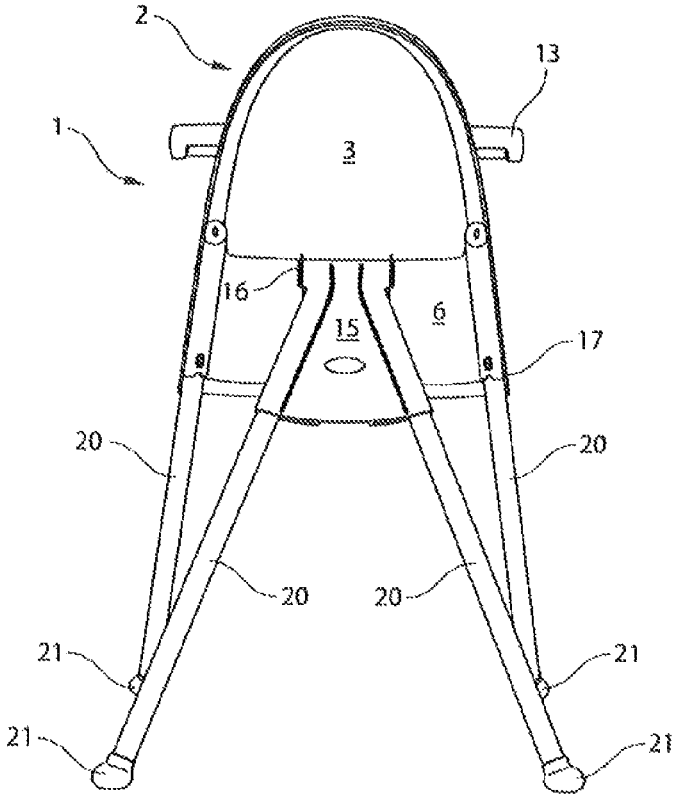
FIG. 2 shows a view from behind of the high chair according to the invention.
Figure 3:
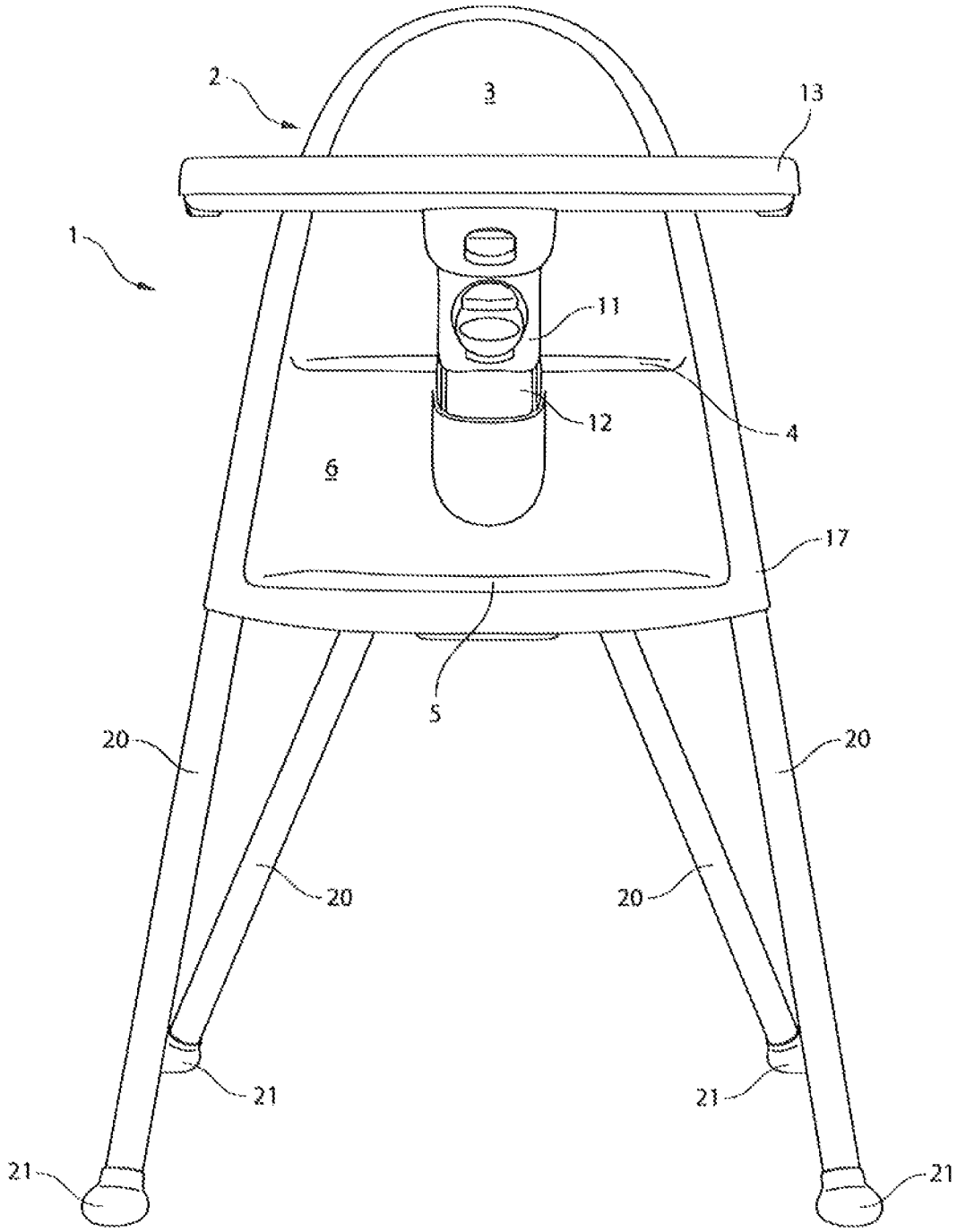
FIG. 3 shows a frontal view of the high chair according to the invention.

The FIGS. 1 to 3 show a chair 1, which comprises a stiff chair unit 2, which comprises a back rest 3, a seat 4 and a foot rest 5, which is integrally connected to the front edge area of the seat 4 through a substantially vertical connection wall 6. The chair unit can for example be manufactured from vacuum-formed plastic, injection-molded plastic and possibly form-pressed wood. A security means 10 comprises a central post 11, which is pivotable in a vertical symmetry plane for the high chair and is at a lower end journalled 12 to the transition area between the seat 4 and the wall 6. At the upper end part of the post 11, a table 13 is arranged, the side of which that faces the back rest 3 has the function of a security yoke.

In the presently preferred embodiment of the invention shown in the figures, the table has a concave side facing the back rest. The invention is however not limited to this embodiment, but instead the table can with maintained high security have a substantially straight side facing the back rest. Instead of the softly rounded concave form it is also possible to form a cavity which is substantially triangular, with the tip of the triangle then lying substantially in the middle of the side of the table and having a radius such that a soft transition is obtained between the sides of the triangle.

Further is shown that the chair unit 2 comprises a link 15, the upper part of which is journalled 16 on a horizontal axis, which is situated adjacent to the transition area between the back rest 3 and the seat 4. The lower end of the link 15 is shown in an extended end position, lying at substantially the same level as the foot rest 5. The lower side edges of the chair unit diverge from each other in downward direction. The link 15 has side edges, which also diverge in a direction downwards. The lower side edges of the chair unit in the area of the foot rest 5 as well as the side edges of the link 15 at the lower end of the link 15, have the form of sleeves or sockets, which receive separate chair legs 20, which are shown to have rounded feet 21, which limits the risk of that the legs 20 hook up on some object on the support surface/floor.

The legs 20 can have a retaining spring, which engages in a corresponding recess in the respective socket 17 in order to guarantee correct orientation of the feet 21. The legs 20 with feet 21 are preferably mutually alike and equally long. The four legs 20 of the high chair converge in pairs in a direction upwards.

Figure 4:
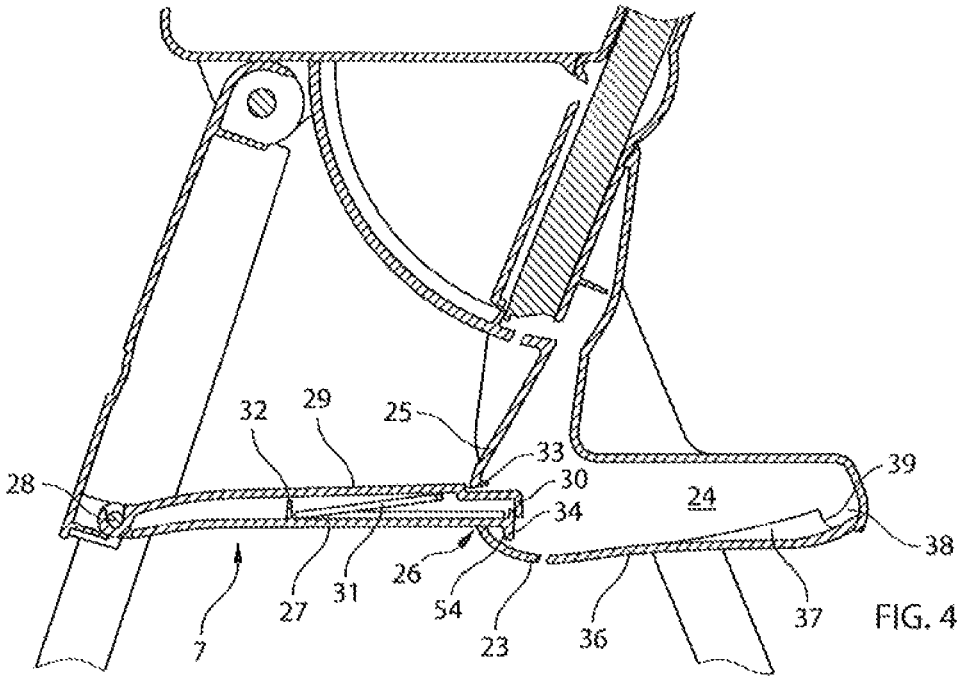
FIG. 4 shows, in enlarged scale, a partially cross-sectional view of a locking mechanism for the rear leg pair of the high chair with these in an extended position.

In FIG. 1 is shown that a cover 23 is mounted on the underside of the chair unit in the area of the wall 6 and footrest 5 in order to screen off a space 24 there between. A disengageable locking device 7 is shown attached between the lower end part of the link 15 and the cover 23 attached to the chair unit 2, as is shown more in detail in FIG. 4 and FIG. 5. As can be seen, the cover 23 has a substantially vertical wall 25 with an opening 26 for a guide rail 27, which is journalled to the lower end part of the link 15 through a bearing 28 with a substantially horizontal axis. A locking element 29 is journalled on the guide rail 27, e.g. journalled around the axis of the bearing 28. The free end 30 of the locking element extends through the opening 26 of the wall 25 when the rear pair of legs is extended. A spring 31 is shown placed between the guide rail 27 and the locking element 29. Alternatively, the locking element itself may by resiliently flexible around the shown support 32 on the guide rail 27, whereby the function of the spring 31 is achieved. Further, the locking element is shown to have an abutment surface 32 formed as a step, which in the extended position of the locking element, when the rear pair of legs is extended, through cooperation with the upper edge part of the opening 26 prevents a retraction of the rear pair of legs. By swivelling the locking element 29 towards the guide rail 27 the abutment surface 33 can be passed through the opening 26.

The locking element has a tip 34, which engages behind the wall 25 in the area of the opening 26. The cover has a substantially horizontal bottom unit 36 with a guide cam 37 for the lower end of the tip 34.

Figure 5:
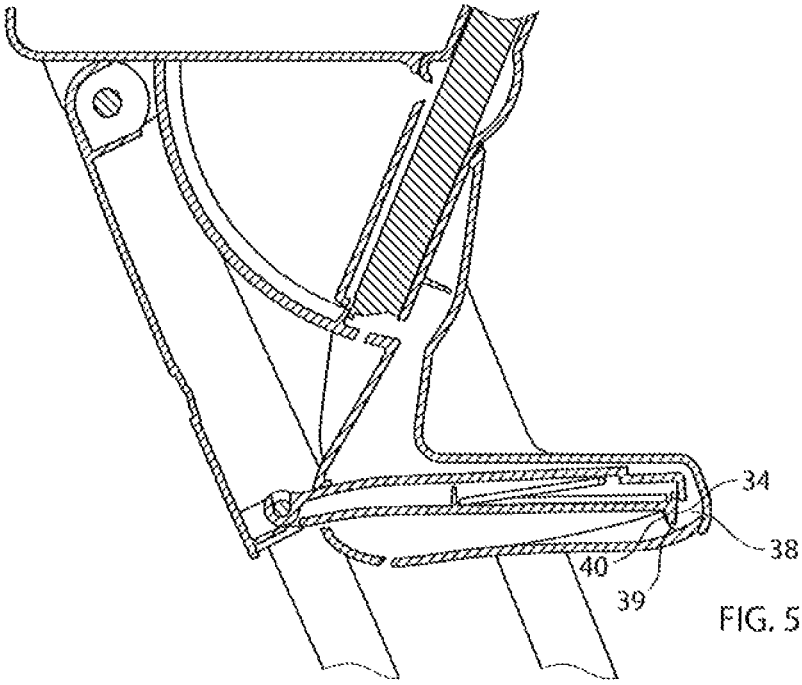
FIG. 5 shows view corresponding to the view of FIG. 4 with the rear leg pair in folded in position.

By manually applying a pressure in the direction downwards against the locking element 29, the locking element 29 will come closer to the guide rail 27 so that the abutment surface 33 of the locking element together with the guide rail 27 can be displaced through the opening 26, whereupon the lower edge of the guide rail 27 and the upper side of the locking element 29 can slide against the lower and upper edge of the opening 26, respectively, during the gliding into the space 24. In the vicinity of the retracted position of the link 15, the tip 34 will slide up on the guide cam 37 and then click down into a recess 38, as is shown in FIG. 5. The ramp has a steep end surface 39, which is turned towards the side 40 of the tip 34 facing it. These surfaces are inclined with respect to the longitudinal direction of the guide rail and further the guide rail 27 is arranged resiliently flexible. When a user wishes to extend the link 15 together with the rear legs 20 towards the extended end position shown in FIG. 1, the user has to apply a comparatively high force in the longitudinal direction of the guide rail 27 in order for the tip 34 to leave the recess 38, which then takes place abruptly. Of course the user cannot arrest the applied force, but will accelerate the link 15 together with the legs 20 and the guide rail 27, so that the momentum becomes sufficient to reliably overcome the friction between the locking element 29 and the guide rail 27 against the upper and the lower edge of the opening 26, respectively, and so that the abutment surface 33 of the locking element safely passes out through the opening 26 and is forced all the way to the arresting position under the influence of the spring 31.

The spring biased locking element 29 offers of course also a childproof catch, which prevents inadvertent retraction of the link 15 with the rear pair of legs 20 towards the retracted position. Preferably the spring force is so high that for a person with normal strength two hands are required in order to disengage the catch.

Each leg 20 can have a groove or protuberance, which cooperates with an accompanying protuberance and groove, respectively, in the sleeve 17 (not shown) in order to guarantee a correct orientation of the respective leg in relation to the sleeve 17, so that the respective foot 21 takes an orientation in relation to the high chair chosen in advance. In the FIGS. 6 and 7*a, b* is shown a presently preferred embodiment of the locking of the legs in the respective socket in a fixed position in order to obtain a correct alignment of the respective foot in relation to the ground.

In FIG. 6 the link 15 is shown with sleeves 17 for the respective leg. The respective sleeve 17 has an opening 171 in a predetermined position. This opening can be designed with upset or chamfered edges in order to facilitate access for a finger. When a leg is correctly placed in its sleeve a blocking means 172 locks the leg in this opening as is explained more in detail below in connection with FIGS. 7*a, b.*

In FIG. 7*a* is shown the upper end of a leg 20 with a blocking means 172, arranged to resiliently protrude through a opening 172 arranged here for. The blocking means 172 in the presently preferred embodiment shown here comprises partly a wire 174 bent into a U-form, which is shown more in detail in FIG. 7*b*, having a shank 175 intended to abut an inner side of the respective leg, diametrically opposed to the opening 173. The bent blocking means 172 is preferably so designed that the wire part 175 forming its extension in the longitudinal direction of the leg 20 lies at an angle in relation to the longitudinal direction of the leg, so that it has a lower height at the end lying closest to the upper end of the leg. Hereby, the mounting of the leg in the chair unit is facilitated to a large extent. Further guide means in the form of a recess or a guide grove may be arranged in connection with the entrance openings of the sleeves.

In FIG. 8 the table 13 is shown folded up into storage position and with the pairs of legs retracted towards each other the chair can be stored e.g. inclined towards a wall while it takes up a minimal amount of space. From user position, which is shown in FIG. 1, where the crotch post is in its raised, blocked position, the table can be folded to an extended position as shown in FIG. 9 or folded down position in relation to the crotch post 11. The movements and the adjustments of the table 13 in relation to the crotch post 11 and thereby to the chair unit 2 is regulated by a control mechanism 47 on the underside of the table, which will be described in detail below. The table has a lower house 49, which through a pivot pin 50 can be pivoted on the upper end of the crotch post between the folded up position, in which the table is kept folded up with a snap lock, which can be disengaged by application of a determined force on the table, and a horizontal position, in which the table is blocked with a blocking means, which is controlled with a childproof mechanism. An embodiment of such a mechanism will be discussed in detail below. The upper end 51 of the crotch post is rounded so that the second linking edge of the house 46 during the whole pivot movement will lie closely adjacent said rounded end, whereby the risk for injury caused by squeezing or that foreign objects will be able to enter, is minimized. On the front side of the upper end is also formed a recess 58 with a step 62, the function of which will be described more closely below.

The swing motion of the crotch post 11 between a folded down resting position and a raised user position is regulated with a blocking mechanism 48, which will also be described in detail below.

In FIG. 10 is shown a cross-section through the table 13 and the upper rounded part 51 of the crotch post 11. The table 13 is displaceable arranged on the house 49 lying underneath the table, for example through rails and groves not shown in detail on the drawing. In the embodiment shown three openings 52 are arranged in the underside of the table, corresponding to three different displacement positions for the table in relation to the crotch post. The first control mechanism 47 consists of a first and a second control button 53, 54. The first control button 53 has a central stem 55, which extends through a hole in the house and which on its end lying outside the house has an enlarged end part 56. This end part has a form and a size corresponding to the form and size of the above mentioned three openings 52 in the underside of the table. Around the stem 54 is arranged a spring 56, which rests against the button and against the inside of the house. When the first control button is depressed against the spring force the enlarged end part 56 is pushed up above the lower limiting wall of the table and thereby the table can be displaced in relation to the crotch post, and thereby the distance between the side of the table facing the chair and the backrest of the chair can be varied. When the button is released and the upper end part 56 ends up in alignment with one of the openings 52 in the underside of the table, the table is locked in the corresponding horizontal position. It shall be noted that the drawings show one embodiment. It is however also possible to arrange a blocking element, which cooperates with a series of indents, so that the table can be substantially continuously variable between two extreme positions, and it is possible to have some kind of friction locking.

The second control button 54 is designed to disengage the table in relation to the crotch post, so that the table can be folded up so that it lies essentially in alignment with the crotch post 11. This second control button is designed as a pull-button. This pull-button 54 is designed with a gripping part 58 and a shank 59 attached thereto and in parallel with the house, which shank extends through a corresponding opening in the house. The pull-button 54 is arranged to be blocked by the first control button 53, when it is in its protruding position. Thereby is achieved that a folding up of the table demands control of both buttons and the probability that this is done unintentionally is practically zero. The shank 59 of the pull-button 54, which extends into the house, is connected to a blocking element 60, which with one end is arranged to extend out through an opening 61 in a part of the house 49, which borders to the upper part of the crotch post 11. This blocking element 60 cooperates with a step 62 in the upper part of the crotch post in such a way that when the blocking element 60 is in the blocking position, the table cannot be pivoted in relation to the crotch post. The blocking element 60 and the shank 59 of the button 54 are displaceable in relation to each other. In the embodiment shown the blocking element 60 is displaceable in groves formed by upright side edges 63, which, as is evident from the view in FIG. 11, are angled at their upper edges in order to prevent the blocking element from being disengaged there from. These side edges have also the task of preventing the pull button from being drawn out of the house. Further, a tongue 64 is arranged in the shank 59 of the pull button, which tongue extends through an opening in the blocking element and keeps the two parts together. When the pull button is drawn out, the blocking element follows and is disengaged from the step in the upper part of the crotch post. Thereby the table can be pivoted freely up to a position, which is substantially in parallel with the crotch post. Preferably the pull button and the blocking element are spring biased in the direction for pushing them together. This can be solved by for example a spring wire 67 tensioned between protrusions 67*a* lying outside the side edges of the pull button, against which spring wire a hook element on the blocking element abuts, as is shown in the detailed view in FIG. 11*a*. Now, when the blocking element abuts the rounded part of the upper end of the crotch post, the two elements forming the pull button are pushed together, whereby the spring force loads the blocking element against the upper end of the crotch post. The underside of the blocking element is chamfered. Thereby is achieved that when the table is in folded up storage position, the spring element biases down behind the upper end of the crotch post, where the rounded form transforms into an end surface. This creates a snap lock, which is easily disengaged by applying a force on the table. When the table is folded back to the blocked user position on the crotch post and the tip of the blocking element ends up below the step 62, the blocking element will snap in under the step because of the spring force and the table is then again blocked on the crotch post.

In FIG. 12 is shown a cross section through the hollow crotch post 11 with a slide 66 moveable therein, which slide is spring biased towards the blocking position. In FIG. 13 is shown an exploded view of the crotch post and the parts comprised therein. The crotch post has a circular cylindrical part 12 between its ends, which is journalled for rotation in an opening in the transition area of the chair between seat and wall for pivoting around an axis 12*a*. The slide 66 has at its upper end a seat 68 for a spring 69 and at its lower end catches 70 intended to cooperate with protrusions 71 formed on the inside of a second cover 72 arranged at the lower end of the crotch post. Further, the slide 66 has an extended opening 73 for receipt of an attachment 75 arranged on a wall element 75 forming the back side of the crotch post. The slide 66 has further catch elements 76 formed to protrude through two elongated openings 77 formed in a wall element 78 forming the front side of the crotch post. The wall element 78 forming the front side of the crotch post is formed with a circular seat 79, shown in detail in the partial view in FIG. 13*a*, for a knob 80. The elongate openings 77 lie on each side of a central opening 81 within an area forming the seat. Within and adjacent to the circumference of the seat are arranged shoulders 82 at a certain distance from each other. The knob 80 is formed with a hub part 83 with a through hole 84 for passage of a bolt or corresponding device through the central hole 81 in the seat 79 for screwing onto the attachment 75 on the opposite wall element of the crotch post. The knob is according to the embodiment shown formed substantially cylindrical with an upper flattened part 85 surrounded by side areas 86 formed like segments of a circle. Opposite to the flattened part 85 the knob has a recess for receiving a spring biased 87 push button 88. The push button 88 has an elongate opening 89, through which the hub part 83 of the knob extends. In a rest position, the push button protrudes out over the outer limit surface of the knob and extends also beyond the shoulders formed in the seat. The width of the push button is thereby adapted to the predetermined distance between the two shoulders 82. As is also evident from the partial view in FIG. 13*a*, the shoulders are chamfered on their underside on their mutually facing ends. These chamferings are intended to cooperate with the push button 88, which has two steps 88*a* adjacent to its lower end. If the knob is turned before the push button 88 against the spring force is pushed into the knob, the push button will get stuck underneath the steps 82, which prevents disengagement of the crotch post. This minimizes the risk for that e.g. siblings open the chair.

The knob 80 has also on its inner side wall elements 90, see the partial view 13*b*, lying substantially horizontally, viewed in the position shown on the drawing, which are intended to act as drivers for the catch elements 76 arranged on the moveable slide.

By depressing the push button in the knob, the knob is disengaged from the shoulders in the seat and thereby the knob can be turned clockwise as well as counter clockwise. At turning one or the other driver, depending on the turning direction, catches one or the other catch element on the spring biased, moveable slide and lifts it up against the spring action. Thereby the blocking protrusions 70 or similar on the slide are disengaged from protrusions on the inside of the cover and the crotch post is disengaged and can be pivoted to a folded down or folded out position. The cover surrounding the lower end of the crotch post is, as is evident from the figure, in this here shown embodiment formed with an outer wall in the form of a segment of a circle. Accordingly it is possible, if it is so wished, to form the cover with one or several further protrusions or corresponding blocking elements to make it possible to arrest the crotch post in several positions.

If the slide cannot be controlled with the aid of the knob, it can be affected from the underside through an opening in the cover 72. A pointed object is introduced through the opening in the cover in order to push the slide up against the action of the spring 69.

The blocking protrusions on the lower end of the slide and the means in the cover cooperating therewith can be formed so that locking of the crotch post in raised position takes place automatically or manually by turning the knob so that the slide is lifted up and the crotch post can be moved to locking position. At present the manual solution is experienced as safer and therefore preferred.

In FIG. 14 is shown a view of the high chair according to the invention with the table 13 in raised, that is user position. As is clearly evident from the figure, the side 91 of the table facing the back rest 3 forms together with the back rest a substantially closed formation, which surrounds a space 92 for a child. In the figure is shown the presently preferred embodiment of the table with a concave side facing the backrest. However, it is obvious that also if the table has a straight side facing the backrest still is achieved a substantially closed formation, which in a safe way keeps a sitting child in the chair.

The invention claimed is:

1. A high chair comprising:

a seat, a back rest, a foot rest, a crotch post, which is journalled for rotation in an opening in the chair in a transition area between the seat and a wall connecting said seat and said foot rest, for pivoting between a raised user position in front of the back rest and a lowered position, and a table arranged on the crotch post, wherein that the table is pivotally attached to the crotch post through a locking mechanism, which is controllable with a control, with which the table can be locked in a horizontal user position, and with which the table can be released, so that it can be angled in relation to the crotch post, preferably to a position in which the table is substantially aligned with the crotch post.

2. The high chair according to claim 1, wherein a rear edge of the table facing-the back rest, when the crotch post is in the user position, together with the back rest is arranged to form a substantially closed formation for safe keeping of a child in the chair.

3. The high chair according to claim 1, wherein the table in the lower position of the crotch post is arranged to lie below an upper surface of the seat and below at least part of an upper surface of the foot rest.

4. The high chair according to claim 1, wherein a rear edge of the table facing the back rest of the chair has the form of a recess directed away from the back rest.

5. The high chair according to claim 1, wherein a rear edge of the table facing the back rest of the chair is concave.

6. The high chair according to claim 1, wherein the table is adjustable in relation to the crotch post, so that a rear edge of the table in a user position facing the back rest of the chair with the aid of a locking mechanism can be locked in at least two different distance positions in relation to the back rest.

7. The high chair according to claim 6, wherein a blocking mechanism consists of a pull button, which is attached to a displaceable blocking element for disengageable engagement with the upper part of the crotch post, that the control mechanism comprises a spring biased push button, which when pushed affects a blocking element, so that it is disengaged from an abutment element of the table cooperating with the blocking element, and which when the push button is released arrests the table in a adjusted displacement position in relation to the back rest of the chair, whereby the push button is designed to block the pull button in the unloaded position, and in the pushed-in position to free the same.

8. The high chair according to claim 1, wherein in user position the crotch post is arranged to be lockable at a back end thereof to the transition area.

9. The high chair according to claim 1, wherein the crotch post has a moveable slide therein, which at its upper end is spring biased in a direction downwards, and which at its lower end has blocking protrusions, which cooperate with blocking means arranged in a cover surrounding an end of the crotch post lying underneath a circular cylindrical part, and in that the slide is arranged to be displaced upwards with a control against spring action so that the blocking protrusions are released.

10. The high chair according to claim 9, wherein the control is designed as a knob having diametrically opposed drivers for cooperation with correspondingly formed hook elements on the slide, so that the knob through turning clockwise as well as counter clockwise performs a lifting action on the slide against the spring force.

11. The high chair according to claim 10, wherein the knob comprises a spring biased push button, which in a non-loaded position blocks turning of the knob and which in pushed-in position admits turning of the knob.

12. The high chair according to claim 1, wherein said chair is configured such that the table can be tilted while it is attached to the chair.

13. The high chair according to claim 1, wherein the crotch post is configured to support the table.

14. A high chair comprising:

a seat, a back rest, a foot rest, a crotch post, which is journalled for rotation in an opening in the chair in a transition area between the seat and a wall connecting said seat and said foot rest, for pivoting between a raised user position in front of the back rest and a lowered position, and a table arranged on the crotch post, wherein that the table is pivotally attached to the crotch post through a locking mechanism, which is controllable with a control, with which the table can be locked in a horizontal user position, and with which the table can be released, so that it can be angled in relation to the crotch post, preferably to a position in which the table is substantially aligned with the crotch post, wherein the table is adjustable in relation to the crotch post, so that a rear edge of the table in a user position facing the back rest of the chair with the aid of a locking mechanism can be locked in at least two different distance positions in relation to the back rest, and wherein a blocking mechanism consists of a pull button, which is attached to a displaceable blocking element for disengageable engagement with the upper part of the crotch post, that the control mechanism comprises a spring biased push button, which when pushed affects a blocking element, so that it is disengaged from an abutment element of the table cooperating with the blocking element, and which when the push button is released arrests the table in a adjusted displacement position in relation to the back rest of the chair, whereby the push button is designed to block the pull button in the unloaded position, and in the pushed-in position to free the same.

15. A high chair comprising:

a seat, a back rest, a foot rest, a crotch post, which is journalled for rotation in an opening in the chair in a transition area between the seat and a wall connecting said seat and said foot rest, for pivoting between a raised user position in front of the back rest and a lowered position, and a table arranged on the crotch post, wherein that the table is pivotally attached to the crotch post through a locking mechanism, which is controllable with a control, with which the table can be locked in a horizontal user position, and with which the table can be released, so that it can be angled in relation to the crotch post, preferably to a position in which the table is substantially aligned with the crotch post, wherein the crotch post has a moveable slide therein, which at its upper end is spring biased in a direction downwards, and which at its lower end has blocking protrusions, which cooperate with blocking means arranged in a cover surrounding an end of the crotch post lying underneath a circular cylindrical part, and in that the slide is arranged to be displaced upwards with a control against spring action so that the blocking protrusions are released.

16. The high chair according to claim 15, wherein the control is designed as a knob having diametrically opposed drivers for cooperation with correspondingly formed hook elements on the slide, so that the knob through turning clockwise as well as counter clockwise performs a lifting action on the slide against the spring force.

17. The high chair according to claim 15, wherein the knob comprises a spring biased push button, which in a non-loaded position blocks turning of the knob and which in pushed-in position admits turning of the knob.

* * * * *